US011305968B1

(12) United States Patent
Maness

(10) Patent No.: US 11,305,968 B1
(45) **Date of Patent: *Apr. 19, 2022**

(54) DYNAMIC ROLLOUT PREVENTION HOOK

(71) Applicant: Lifesaving Systems Corporation, Apollo Beach, FL (US)

(72) Inventor: Samuel Gene Maness, Apollo Beach, FL (US)

(73) Assignee: Lifesaving Systems Corporation, Apollo Beach, FL (US)

( * ) Notice: Subject to any disclaimer, the term of this patent is extended or adjusted under 35 U.S.C. 154(b) by 81 days.

This patent is subject to a terminal disclaimer.

(21) Appl. No.: 16/857,299

(22) Filed: Apr. 24, 2020

Related U.S. Application Data

(63) Continuation-in-part of application No. 16/174,480, filed on Oct. 30, 2018, now Pat. No. 10,669,129.

(60) Provisional application No. 62/657,254, filed on Apr. 13, 2018.

(51) Int. Cl.
*B66C 1/36* (2006.01)

(52) U.S. Cl.
CPC ..... *B66C 1/36* (2013.01)

(58) Field of Classification Search
CPC ..... B66C 1/26; B66C 1/36; F16B 45/02
USPC ..... 294/82.19, 82.2, 82.21, 82.33, 82.34
See application file for complete search history.

(56) References Cited

U.S. PATENT DOCUMENTS 1,392,260 A * 9/1921 Schollar ..... F16B 45/02 294/82.24
1,532,927 A * 4/1925 Nowland ..... B66C 1/36 24/599.5
1,725,609 A * 8/1929 Amos ..... B66C 1/36 294/82.19
1,915,524 A * 6/1933 Fraser ..... B66C 1/36 24/599.1
3,575,458 A * 4/1971 Crook, Jr ..... B66C 1/36 294/82.2
4,293,156 A * 10/1981 Chapalain ..... B66C 1/36 24/600.2
4,309,052 A * 1/1982 Drayton ..... B66C 1/36 24/599.5
D389,983 S * 1/1998 Maness ..... D34/35
7,320,159 B2 * 1/2008 Petzl ..... F16B 45/02 24/599.5
9,470,258 B2 * 10/2016 Fitz-Earle ..... F16B 45/02
10,669,129 B2 * 6/2020 Maness ..... B66C 1/36
(Continued)

*Primary Examiner* — Dean J Kramer
(74) *Attorney, Agent, or Firm* — Nicholas Pfeifer; Smith & Hopen, P. A.

(57) ABSTRACT

A hook gate or hoist hook having a hook gate that is designed to prevent dynamic rollout. The lockable gate includes one or more release mechanisms that allow the gate to unlock and open upon actuation of the release mechanisms. The release mechanisms reside within a circumferential guard that extends outwardly from the gate. The guards preferably extend at least as far as the release mechanism or beyond the extension of the release mechanism. The hook gate further includes anti-snagging flanges extending generally in the vertical direction from both the top and bottom portions of the guard. The circumferential guard and the anti-snagging flanges in combination make it nearly impossible for an attachment mechanism to become improperly oriented under a load and effectively eliminate the possibility of dynamic rollout.

19 Claims, 7 Drawing Sheets

(56) References Cited

U.S. PATENT DOCUMENTS

2015/0033515 A1* 2/2015 Lai ..... F16B 45/02
24/594.1

* cited by examiner

DYNAMIC ROLLOUT PREVENTION HOOK

CROSS-REFERENCE TO RELATED APPLICATIONS

This nonprovisional application is a continuation of and claims priority to nonprovisional application Ser. No. 16/174,480, entitled "DYNAMIC ROLLOUT PREVENTION HOOK," filed Oct. 30, 2018 by the same inventors, which claims priority to provisional application No. 62/657,254, entitled "DYNAMIC ROLLOUT PREVENTION HOOK," filed Apr. 13, 2018 by the same inventors.

BACKGROUND OF THE INVENTION

1. Field of the Invention

This invention relates, generally, to hooks. More specifically, it relates to a novel hook/hook gate design that eliminates dynamic rollout during hoisting operations.

2. Brief Description of the Prior Art

In the world of helicopter rescue, there has long existed the problem of what the industry knows as "dynamic rollout." Dynamic rollout (also referred to as "D-ring reversal" or "ring rollout") occurs when the geometry of the attachment hardware (typically a ring having a circular shape (see FIG. 1) or triangular shape (see FIG. 2)) used to connect a person or rescue device to a hoist hook is such that the attachment hardware has the ability to turn over and unintentionally drop out of the hook. An image of this deadly scenario is provided in FIG. 1, which shows attachment hardware 12 improperly oriented on hook gate 14 rather than hanging from the body of hoist hook 10.

When attachment hardware 12 is properly oriented on hoist hook 10, gravity will cause attachment hardware 12 to properly rest on the bottom most curved section of hoist hook 10. However, in situations where hook 10 and attachment hardware 12 hang loose, such as when a rescuer is in the water or working on the ground or cliffside, attachment hardware 12 and hook 10 can become improperly orientated similar to the orientation depicted in FIG. 1. In this orientation, a slight jostle or increased weight on attachment hardware 12 can cause attachment hardware 12 to pass between hook beak 16 and hook gate 14, and attachment hardware 12 resultingly drops out of hook 10. This unfortunate occurrence is the problem introduced earlier as "dynamic rollout." Unfortunately, dynamic rollout has been the cause of many deaths and the industry has rightfully demanded better hook-attachment hardware designs.

Historically, the U.S. Coast Guard prevented dynamic rollout by carefully controlling the design of the attachment hardware. By controlling the geometry of attaching hardware 12 and ensuring that the receiving space 18 is too small to create an unsafe condition, the Coast Guard was able to eliminate the possibility of dynamic rollout. A smaller receiving space 18, as in the "V-ring" pictured in FIG. 2, makes dynamic rollout with hook 10 impossible.

As helicopter rescue/hoisting has spread to the commercial sector, standards for attachment hardware have proved elusive. The hook-to-attachment hardware interface is always changing amongst manufactures. The size and shape of the attachment hardware and the design of the hooks vary amongst manufacturers and certain attachment hardware, if used with certain hooks, is susceptible to dynamic rollout.

While there are locking gates on helicopter hoist hooks, the locking/release mechanisms are either partially or fully exposed and therefor can be, and have been, inadvertently depressed by rings or other equipment that hangs from the hook during hoisting operations. The current designs are also shaped in ways that can cause rings and other equipment to snag or jam on the hook creating unsafe conditions for operators. These snag points cause rings and carabiners attached to the hook to become jammed or to hang on the gate mechanism during hoisting.

The inventor previously created the first ever hoist hook having a locking gate with a double-actuated release mechanism. The design, as depicted in FIG. 3, helped prevent accidental rollout because both of the first and second release mechanisms 20*a*, 20*b*, one on either lateral surface, must be simultaneously actuated to unlock hook gate 14. The addition of opposing release mechanisms all but eliminated dynamic rollout. Other manufacturers followed suit and added more secure locks to helicopter hoist hooks.

As rescue organizations all over the world grew their helicopter rescue programs, the tactics, techniques, and procedures used in hoisting have changed. Many rescue teams 'double-up' or put more than one person on the hook at the same time. Also, the varying makes and models of rescue gear that attach to hoist hooks has grown and changed.

Aviation authorities, like SACA in Australia and the FAA in the U.S.A. have warned against the possibility of dynamic rollout, even with the proliferation of locking hooks, and warned operators in published alerts to evaluate the attaching hardware for its ability to defeat the gate of any hook in use. When these conditions exist, either the hook or the hardware should be changed.

While attending the Helicopter Association International trade show, Applicant was made aware of a piece of hardware (in this case, a SETS lifting strap) that had the ability—when manipulated in the right way—to depress both latches of Applicant's hoist hook and open the gate, effectively rolling out of a hook designed to defeat rollout. The lifting strap, if pulled tightly around front face 24 of hook gate 14, was able to depress both the first and second release mechanisms 20*a*, 20*b* to unlock hook gate 14.

Though there is no proof any rollout has occurred in operational use, the possibility of the unlocking of a locking hoist hook is concerning. There have also been more and more situations in which Applicant's hoist hook are being used in ways that were unheard of a decade ago, with more and more equipment being attached on or in close proximity to the hoist hook.

Accordingly, what is needed is a new design for a hoist hook that prevents dynamic rollout as a result from contact with any hardware that may be attached to the hoist hook. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for a hoist hook that is insusceptible to dynamic rollout as a result from contact with any hardware that may be attached to the hoist hook is now met by a new, useful, and nonobvious invention.

The novel structure includes a hook gate having a main body with a front facing surface, a pair of lateral sides, a first release mechanism, and a second release mechanism. The first release mechanism has an actuatable contact accessible by a user and, in an embodiment, is secured to the first lateral side. Likewise, the second release mechanism has an actuatable contact accessible by the user and, in an embodiment, is secured to the second lateral side.

A first guard circumferentially surrounds at least the actuatable contact of the first release mechanism and extends away from the main body beyond the actuatable contact of the first release mechanism. Similarly, a second guard circumferentially surrounds at least the actuatable portion of the second release mechanism and extends away from the main body beyond the actuatable contact of the second release mechanism. In an embodiment, each guard includes an upper section, a front section, a bottom section, and a portion of the respective release mechanism to completely surround the actuatable contact. In an embodiment, the front section of the guard extends from the front facing surface of the main body.

In an embodiment, the front facing surface includes a first upper tapered flange, a second upper tapered flanges, a first lower tapered flanges, and a second lower tapered flange. The first upper tapered flange extends upwardly from the first guard and tapers towards an upper end of the hook gate. The first lower tapered flange extends downwardly from the first guard and tapers towards a bottom end of the hook gate. The second upper tapered flange extends upwardly from the second guard and tapers towards an upper end of the hook gate. Lastly, the second lower tapered flange extends downwardly from the second guard and tapers towards a bottom end of the hook gate.

In an embodiment, the front facing surface is convex. The curvature of the front facing surface prevents unwanted snagging where the hook gate meets the hook beak.

An embodiment includes the actuatable contact of the first and second release mechanisms being laterally compressible. In addition, each of the first and second release mechanisms requires a predetermined amount of compression to reach an actuation point at which the hook gate becomes unlocked.

In an embodiment, each of the actuatable portions of the release mechanisms has a visual indicator to visually distinguish each of the actuatable portions from other portions of the hook gate.

These and other important advantages and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
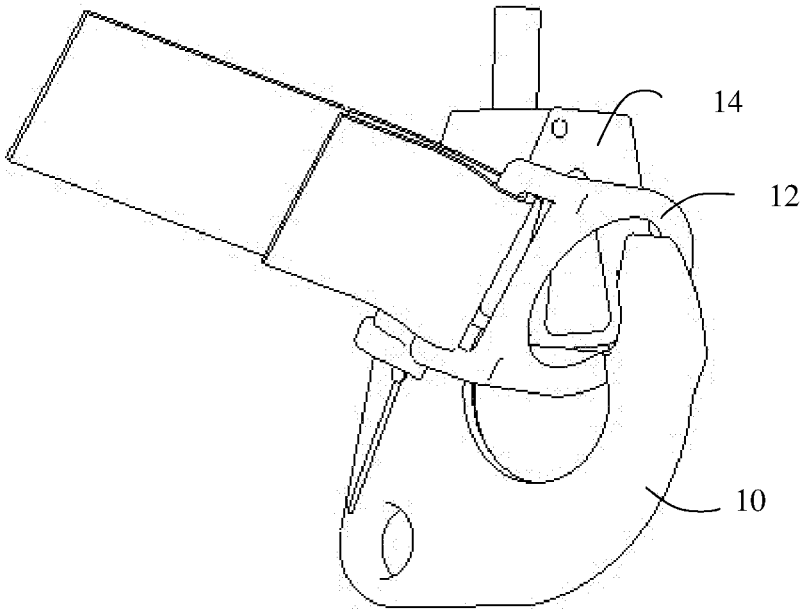
Fig. 1 (Prior art)
FIG. 1 is a perspective view of a prior art attachment hardware improperly oriented on a prior art hoist hook, such that the assembly is susceptible to dynamic rollout.
Figure 2:
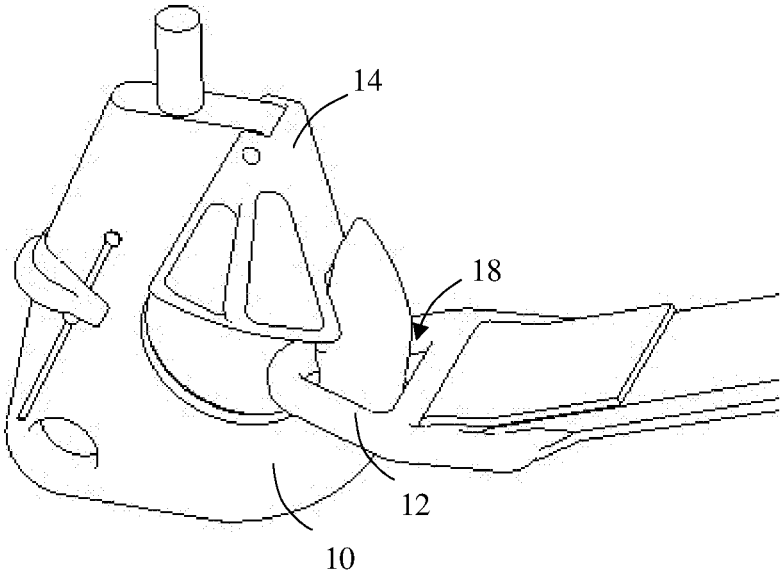
Fig. 2 (Prior art)
FIG. 2 is a perspective view of a triangular shaped attachment hardware properly oriented with respect to a prior art hoist hook.
Figure 3A:
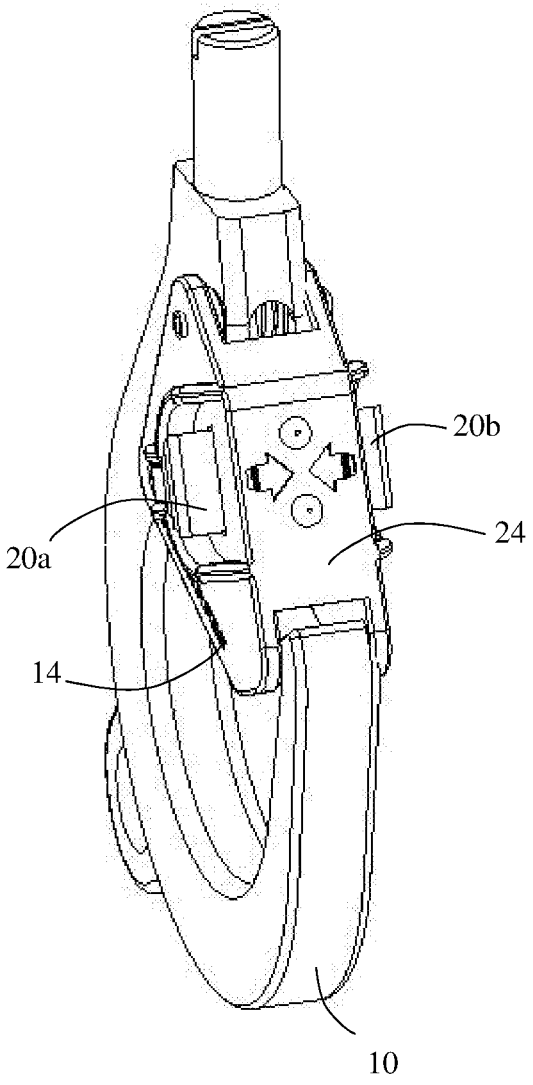
Fig. 3A (Prior art)
FIG. 3A is an isometric view of the inventor's previous design.
Figure 3B:
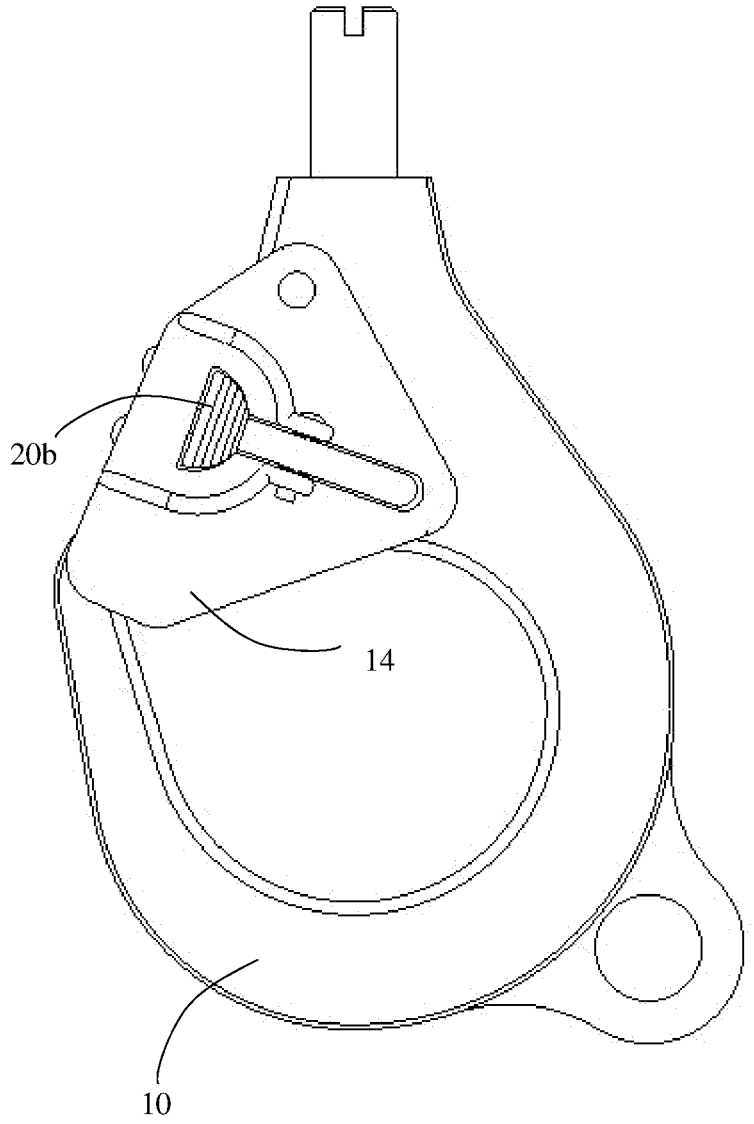
Fig. 3B (Prior art)
FIG. 3B is a side view of the inventor's previous design.
Figure 4:
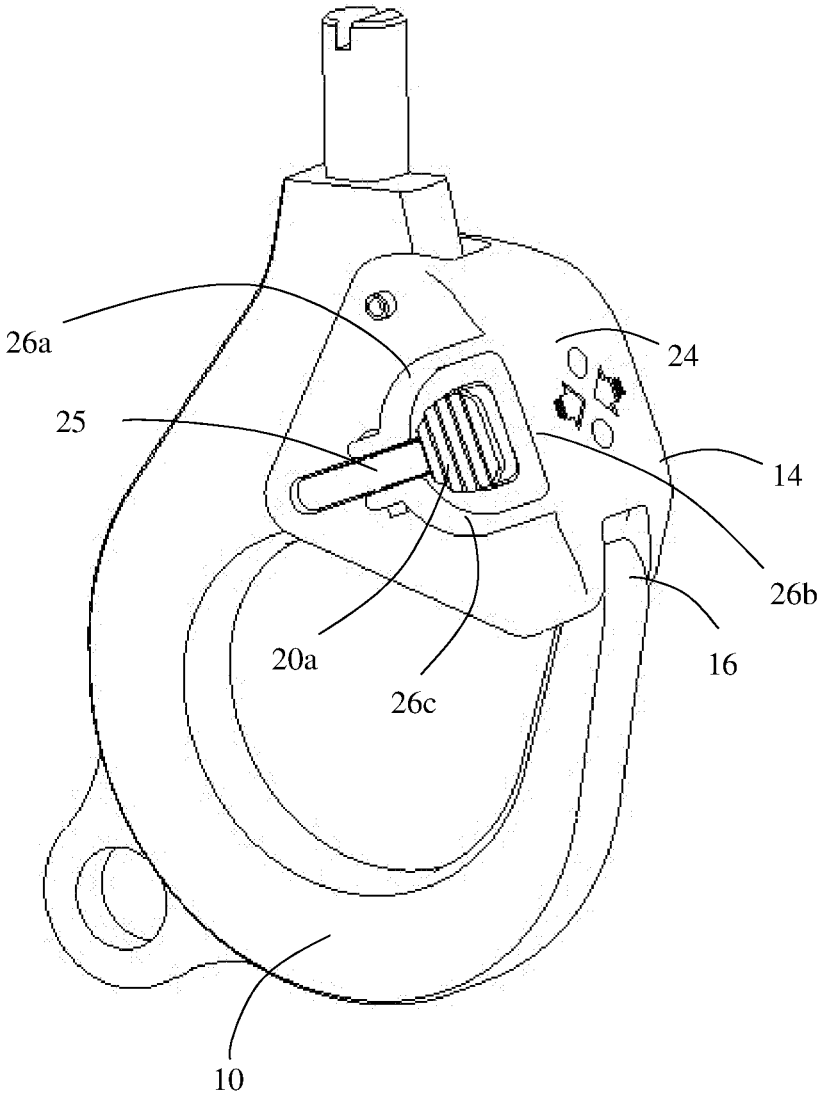
FIG. 4 is a perspective view of the present invention.
Figure 5:
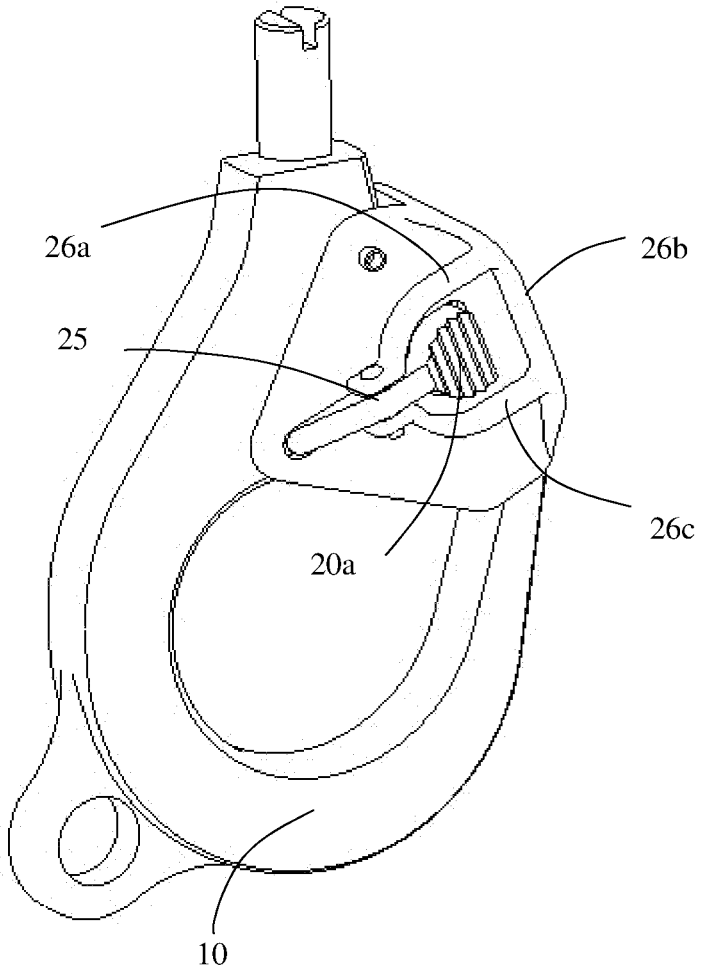
FIG. 5 is a rear perspective view of the present invention.

In the following detailed description of the preferred embodiments, reference is made to the accompanying drawings, which form a part thereof, and within which are shown by way of illustration specific embodiments by which the invention may be practiced. It is to be understood that other embodiments may be utilized, and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes a novel non-obvious improvement to the inventor's previous hoist hook to eliminate the possibility of dynamic rollout that has plague the recuse industry for decades. As previously explained it was determined that in rare situations both release mechanisms 20*a*, 20*b* on the previous design could be accidentally actuated by hardware secured to hoist hook 10. This issue stems from the fact that forward-facing section 24 of hook gate 14 does not guard against objects contacting release mechanisms 20*a*, 20*b*. The forward end of hook gate 14 is unobstructed. Originally, the lack of obstruction was intended to aid rescuers in compressing release mechanisms 20*a*, 20*b*. However, the lack of obstruction also allows hardware to accidentally contact release mechanisms 20*a*,

20*b*. The issue, however, only became apparent after more than two decades of use. The present invention is designed to eliminate not only dynamic rollout, but also the unintentional activation of both release mechanisms.

As shown in FIGS. 4-7, the present invention eliminates this dynamic rollout through the re-invention of hook gate 14. As depicted, hook gate 14 now includes fully-circumferential guards 26 surrounding each release mechanism 20*a*, 20*b*. Each release mechanism 20*a*, 20*b* resides within the perimeter of circumferential guard 26, such that typical hardware used in rescue operations is incapable of accidentally actuating release mechanisms 20*a*, 20*b*. Circumferential guards 26 each includes upper section 26*a*, front section 26*b*, bottom section 26*c*, and pivot point 25 of release mechanism 20*a*, 20*b* to create a completely surrounding guard. Front section 26*b* eliminates the dangerous situation present in the previous design where straps or other hardware can wrap around the front surface of the hook gate and actuate both release mechanisms.

In an embodiment, release mechanisms 20*a*, 20*b* may have a particular design lacking pivot point 25 that intercepts and forms part of the perimeter of circumferential guard 26. In such an instance, upper section 26*a* and bottom section 26*c* would meet to ensure that the perimeter of circumferential guard 26 is continuous.

The distance between release mechanisms 20*a*, 20*b* and their respective guards 26 is also an important consideration. The minimum distance between release mechanisms 20*a*, 20*b* and their respective guards 26 is preferably 0.1875 inches, but it is considered that the minimum distance can be between 0.125 inches and 0.375 inches. If the perimeter of circumferential guard 26 is too large, or the distance between release mechanisms 20*a*, 20*b* and their respective guards 26 is too great, the chances of a piece of hardware passing within the perimeter of guards 26 also increases. The perimeter of the guard is of a size to receive a wet glove in a cold environment, but preferably no greater. For example, the total perimeter is preferably about 3.14 inches, but the total perimeter can be between 2.35 inches and 3.92 inches. In terms of total area, the desired value is preferably about 0.785 squared inches. It is considered, however, that the total area can be between 0.44 squared inches and 1.22 squared inches. For a generally circular perimeter, each guard preferably has a 1 inch diameter. In an embodiment, however, a generally circular perimeter has a diameter between 0.75 inches and 1.25 inches.

While a fully circumferential guard is preferable, it is also considered that the guard can be comprised of a plurality of discontinuous sections that generally form a circumferential guard by keeping the discontinuous section closely spaced. The closely spaced subsections of the guard will however, create snagging points, whereas a fully circumferential guard will avoid snags.

An embodiment includes upper tapered flanges 28 and lower tapered flanges 30 that are integrated/extend laterally a predetermined distance. Upper tapered flanges 28 and lower tapered flanges 30 are preferably in plane with front surface 24. In an embodiment, the predetermined lateral extent of upper tapered flanges 28 and lower tapered flanges 30 is equal to the lateral extent of perimeter guards 26. Upper flanges 28 taper inwards moving up and away from perimeter guards 26. Likewise, lower flanges 30 taper inwards moving down and away from perimeter guards 26.

Upper tapered flanges 28 and lower tapered flanges 30 are tapered to prevent equipment and objects from snagging on circumferential guards 26. Without the tapered flanges 28, 30, each circumferential guard 26 would present a shelf on which hardware can inadvertently hang.

For a similar reason, an embodiment of hook gate 14 also includes a bulbous front facing surface 24. A smoothly curved front facing surface 24 further prevents of unwanted snagging or hanging where hook beak 16 meets hook gate 14. In an embodiment, the curvature of front surface 24 matches the curvature of hook beak 16 to further reduce the chance of equipment and objects snagging on the point where hook gate 14 meets hook beak 16.

As depicted, release mechanisms 20*a*, 20*b* are in the form of a laterally compressible, pivoting button/actuator. The compressible actuators have a position of repose and a pivoted/compressed position with a point of actuation occurring between the two positions or at the fully compressed position. An embodiment may include other types of release mechanisms so long as they reside within the circumferential guard. Such release mechanisms include but are not limited to slidable actuated release mechanisms and rotatable actuated release mechanisms.

When release mechanisms 20*a*, 20*b* are laterally compressible actuators, the compressible actuators preferably do not extend in a lateral direction beyond the extension of guards 26 in the lateral direction (i.e. the height of guards 26) when actuators 20*a*, 20*b* are in a position of repose. If the release mechanisms 20*a*, 20*b* laterally extend beyond the height of guards 26, the point of actuation does not occur until actuators 20*a*, 20*b* are compressed laterally inward past the outward lateral extension of the guards 26. In other words, both actuators 20*a*, 20*b* must be compressed towards hook gate 14 beyond the height of the guards 26 to unlock hook gate 14.

In an embodiment, the hook/hook gate has a single circumferentially guarded release mechanism. In an embodiment, the release mechanism may reside on the front or rearward surfaces of the gate and/or hook rather than the lateral surface as depicted in the exemplary figures. An embodiment may also include the release mechanism and circumferential guard residing at least partially on the body of the hook rather than the body of the gate.

Figure 6:
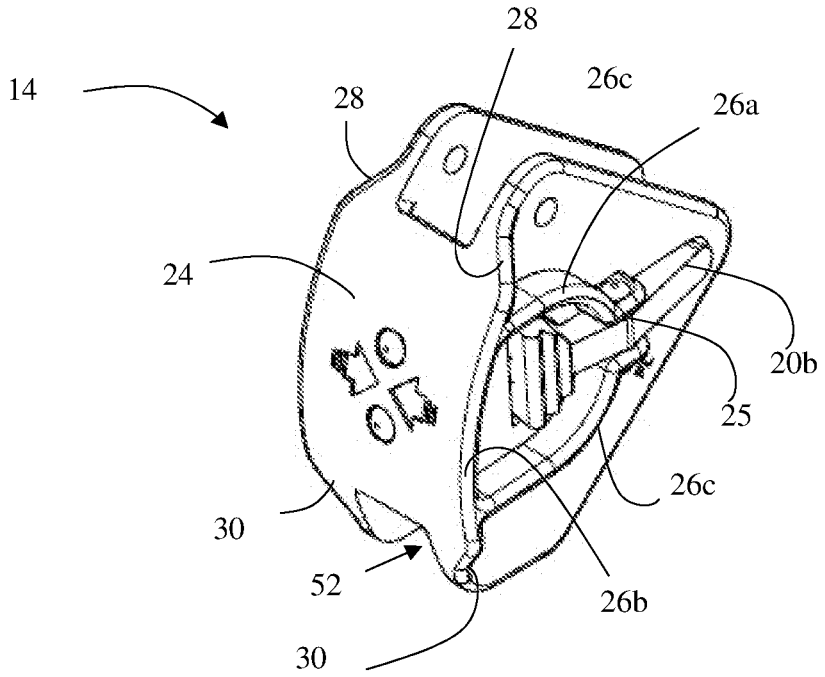
FIG. 6 is a front perspective view of the hook gate of the present invention removed from the hoist hook.
Figure 7:
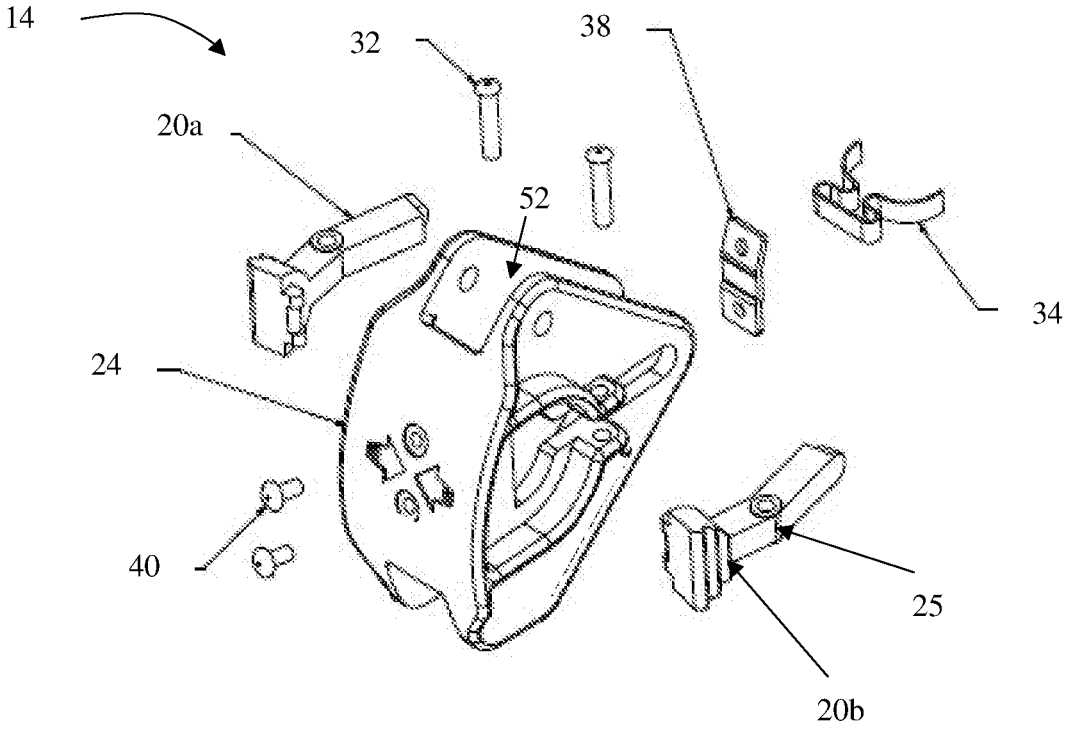
FIG. 7 is an exploded view of the hook gate of the present invention.

Referring now to FIGS. 6 and 7, hook gate 14 includes two release mechanisms 20*a*, 20*b* that are held in place by and pivot about latch gate rivets 32. Release mechanisms 20*a*, 20*b* are held in a position of repose, i.e. the locked position of gate 14, by the spring force of latch spring 34, which is secured on the inside surface of front face 24 by spring mount 38. Spring mount 38 is secured to the inside surface of front face 24 by two spring rivets 40. Release mechanisms 20*a*, 20*b* can be compressed inwardly to overcome the spring force of latch spring 34, and release mechanisms 20*a*, 20*b* pivot about latch gate rivets 32 causing the back ends (the ends furthest from the front face of the hook gate) of release mechanisms 20*a*, 20*b* to move laterally outward and out of contact with gate seat 50 on hook 10. Once the back ends of release mechanisms 20*a*, 20*b* are no longer in contact with gate seat 50, hook gate 14 is free to pivot about rivet 46 and the hollowed out interior 52 of hook gate 14 can receive gate seat 50 as hook gate 14 pivots away from hook beak 16.

Figure 8:
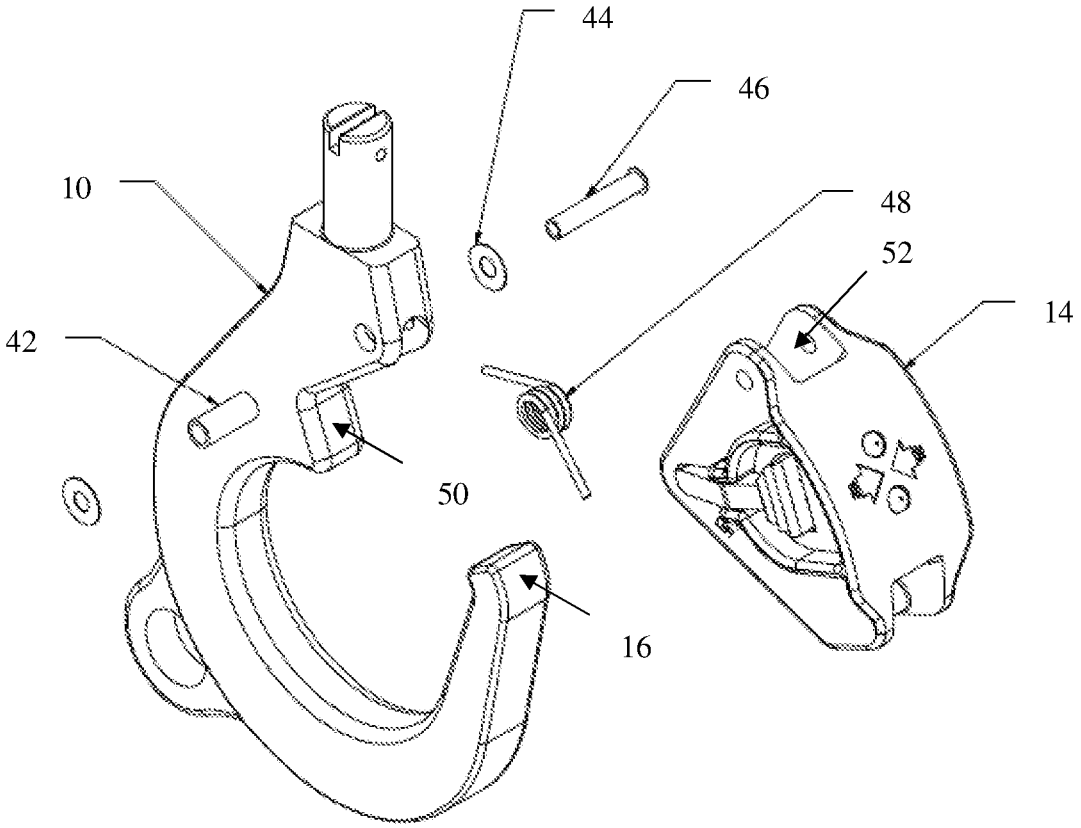
FIG. 8 is an exploded view of the hook gate and hook of the present invention.

As depicted in FIG. 8, hook gate 14 is attached to a properly sized and configured hoist hook 10 by riveting hook gate 14 to the apex of the hoist hook 10 via rivet assembly 42, 44, 46. The inclusion of torsion spring 48 behind hook gate 14 forces the gate closed against the opening of the hoist hook 10.

By depressing spring-loaded release mechanisms 20*a*, 20*b*, hook gate 14 can be swung open to allow for the attachments of lifting rings, carabiners, and other objects to hoist hook 10. When the gate is released, spring 48 forces hook gate 14 closed and release mechanisms 20*a*, 20*b* return to the locked position (i.e. position of repose) with the back ends of release mechanisms 20*a*, 20*b* engaging gate seat 52. As a result, hook gate 14 is closed and in a locked position. Guards 26 that surround release mechanisms 20*a*, 20*b* prevent rings, carabiners, or any other objects from unintentionally actuating release mechanisms 20*a*, 20*b*, ensuring that hook gate 14 stays locked in even the most unpredictable conditions. In addition, tapered flanges 28, 30 and the curved shape of front facing surface 24 ensure that any hardware that comes into contact with hook gate 14 will remain free to roll back into a proper hanging position once returned to a load. Accordingly, this novel design eliminates the possibility of snagging or jamming.

In an embodiment, both hook gate 14 and release mechanisms 20*a*, 20*b* are comprised of stainless steel and maybe be created via lost wax casting. The parts may also be heat-treated for hardness. Hook gate 14 and release mechanisms 20*a*, 20*b* are preferably tumbled and polished (burnished) and paint is applied to release mechanisms 20*a*, 20*b* to highlight the release mechanisms 20*a*, 20*b* which may be difficult to see in certain rescue missions. Rivets 32 and 40 are available commercially from a number of sources. Spring mount 38 and latch spring 48 are custom made out of stainless steel and may be formed by stamping, forming, and heat treating. The components are then riveted together using an impact riveter. It is considered that other methods and materials may be used.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A hook gate that is insusceptible to dynamic rollout, the hook gate comprising:

a main body having a first lateral side, a second lateral side opposite the first lateral side, and a front facing surface;

the front facing surface being convex, such that the front surface arcs outwardly from an upper end of the main body of the hook gate towards a lower end of the main body of the hook gate to prevent any objects from accidentally catching on the hook gate;

a first release mechanism secured to the first lateral side, wherein at least a portion of the first release mechanism is actuatable by a user;

a second release mechanism secured to the second lateral side, wherein at least a portion of the second release mechanism is actuatable by the user;

a first guard extending a predetermined distance in a lateral direction from at least a portion of the first lateral side, wherein the first guard surrounds at least the actuatable portion of the first release mechanism thereby preventing accidental actuation of the first release mechanism;

a second guard extending a predetermined distance in the lateral direction from at least a portion of the second lateral side, wherein the second guard surrounds at least the actuatable portion of the second release mechanism thereby preventing accidental actuation of the second release mechanism;

whereby simultaneous actuation of the first and second release mechanisms allows the hook gate to open, the front facing surface further including:

the first upper tapered flange and a second upper tapered flange;

the first upper tapered flange extending upwardly from the first guard and tapering towards an upper end of the hook gate; and the second upper tapered flange extending upwardly from the second guard and tapering towards an upper end of the hook gate.

2. The hook gate of claim 1, wherein the front facing surface further includes:

a first lower tapered flange and a second lower tapered flange;

the first lower tapered flange extending downwardly from the first guard and tapering towards a bottom end of the hook gate;

the second lower tapered flange extending downwardly from the second guard and tapering towards a bottom end of the hook gate.

3. The hook gate of claim 1, wherein the predetermined distance that the first and second guards extend in the lateral direction is greater than or equal to a distance that the actuatable portions of the first and second release mechanisms extend in the lateral direction.

4. The hook gate of claim 1, wherein the actuatable portions of the first and second release mechanisms are laterally compressible, and each of the first and second release mechanisms requires a predetermined amount of compression to reach an actuation point at which the hook gate becomes unlocked.

5. The hook gate of claim 1, wherein each guard includes an upper section, a front section, a bottom section, and a portion of the respective release mechanism to completely surround each actuatable portion for each release mechanism.

6. The hook gate of claim 5, wherein the front section of the guard extends from the front facing surface of the hook gate.

7. The hook gate of claim 1, wherein each of the actuatable portions of the release mechanisms has a visual indicator to visually distinguish each of the actuatable portions from other portions of the hook gate.

8. A hook gate that eliminates the possibility of dynamic rollout, the hook gate comprising:

a main body having a first release mechanism and a second release mechanism;

a convex front facing surface that arcs outwardly from an upper end of the main body of the hook gate towards a lower end of the main body of the hook gate to prevent any objects from accidentally catching on the hook gate;

the first release mechanism having an actuatable contact accessible by a user;

the second release mechanism having an actuatable contact accessible by the user;

a first guard surrounding the actuatable contact of the first release mechanism, the first guard extending away from the main body beyond the actuatable contact of the first release mechanism;

a second guard surrounding the actuatable contact of the second release mechanism, the second guard extending away from the main body beyond the actuatable contact of the second release mechanism;

the front facing surface further including:

a first upper tapered flange and a second upper tapered flange;

the first upper tapered flange extending upwardly from the first guard and tapering towards an upper end of the hook gate;

the second upper tapered flange extending upwardly from the second guard and tapering towards an upper end of the hook gate;

whereby the first and second guards prevent accidental actuation of the first and second release mechanisms to prevent dynamic rollout.

9. The hook gate of claim 8, wherein the front facing surface further includes:

a first lower tapered flange and a second lower tapered flange;

the first lower tapered flange extending downwardly from the first guard and tapering towards a bottom end of the hook gate;

the second lower tapered flange extending downwardly from the second guard and tapering towards the bottom end of the hook gate.

10. The hook gate of claim 8, wherein the actuatable contact of the first and second release mechanisms are laterally compressible, and each of the first and second release mechanisms requires a predetermined amount of compression to reach an actuation point at which the hook gate becomes unlocked.

11. The hook gate of claim 8, wherein each guard includes an upper section, a front section, a bottom section, and a portion of the respective release mechanism to completely surround the actuatable contact.

12. The hook gate of claim 11, wherein the front section of the guard extends from a front facing surface of the main body.

13. The hook gate of claim 8, wherein each of the actuatable contacts of the release mechanisms has a visual indicator to visually distinguish each of the actuatable contacts from other portions of the hook gate.

14. A hook gate to eliminate the possibility of dynamic rollout, comprising:

a main body having a front facing surface, a first release mechanism, and a second release mechanism;

the front facing surface being convex, such that front facing surface arcs outwardly from the open retention area from an upper end of the main body of the hook gate towards a lower end of the main body of the hook gate to prevent any objects from accidentally catching on the hook gate;

the convex curve of the front facing surface matching a curvature of a hook beak when the hook gate is in a closed position;

the first release mechanism having an actuatable contact accessible by a user;

the second release mechanism having an actuatable contact accessible by the user;

a first guard circumferentially surrounding the actuatable contact of the first release mechanism, the first guard extending away from the main body beyond the actuatable contact of the first release mechanism; and a second guard circumferentially surrounding the actuatable contact of the second release mechanism, the second guard extending away from the main body beyond the actuatable contact of the second release mechanism; the front facing surface further including:

a first upper tapered flange and a second upper tapered flange;

the first upper tapered flange extending upwardly from the first guard and tapering towards an upper end of the hook gate; and the second upper tapered flange extending upwardly from the second guard and tapering towards an upper end of the hook gate.

15. The hook gate of claim 14, wherein the front facing surface further includes:

a first lower tapered flange and a second lower tapered flange;

the first lower tapered flange extending downwardly from the first guard and tapering towards a bottom end of the hook gate;

the second lower tapered flange extending downwardly from the second guard and tapering towards a bottom end of the hook gate.

16. The hook gate of claim 14, wherein the actuatable contact of the first and second release mechanisms are laterally compressible, and each of the first and second release mechanisms requires a predetermined amount of compression to reach an actuation point at which the hook gate becomes unlocked.

17. The hook gate of claim 14, wherein each guard includes an upper section, a front section, a bottom section, and a portion of the respective release mechanism to completely surround the actuatable contact.

18. The hook gate of claim 17, wherein the front section of the guard extends from the front facing surface of the main body.

19. The hook gate of claim 14, wherein each of the actuatable contacts of the release mechanisms has a visual indicator to visually distinguish each of the actuatable contacts from other portions of the hook gate.

* * * * *